US005385025A

United States Patent [19]

Kellett

[11] Patent Number: 5,385,025

[45] Date of Patent: Jan. 31, 1995

[54] APPARATUS AND METHOD FOR DISPENSING DROPLETS OF A CRYOGENIC LIQUID

[75] Inventor: Stephen G. Kellett, Chesterfield, Mo.

[73] Assignee: MG Industries, Malvern, Pa.

[21] Appl. No.: 205,371

[22] Filed: Mar. 4, 1994

[51] Int. Cl.[6] ..... F17C 7/02

[52] U.S. Cl. ..... 62/50.1; 62/50.4; 62/50.7; 141/64

[58] Field of Search ..... 62/48.1, 50.1, 50.2, 62/50.4, 50.7, 51.1, 60; 141/64, 67

[56] References Cited

U.S. PATENT DOCUMENTS

| | | | |
|---|---|---|---|
| 4,059,424 | 11/1977 | Bentz . | |
| 4,203,299 | 5/1980 | Dinglinger | 62/50.1 X |
| 4,489,767 | 12/1984 | Yamada | 141/48 |
| 4,499,931 | 2/1985 | Urban | 141/67 |
| 4,523,433 | 6/1985 | Takahashi et al. | 62/60 |
| 4,546,609 | 10/1985 | Roullet et al. . | |
| 4,561,258 | 12/1985 | Brodbeck et al. | 62/50.1 |
| 4,588,000 | 5/1986 | Malin et al. | 141/1 |
| 4,662,154 | 5/1987 | Hayward | 141/64 X |
| 4,715,187 | 12/1987 | Stearns . | |
| 4,805,806 | 2/1989 | Smith | 222/146.6 |
| 4,854,128 | 8/1989 | Zeamer | 62/50.1 |
| 5,018,358 | 5/1991 | Lee et al. | 62/48.1 |
| 5,101,636 | 4/1992 | Lee et al. | 62/48.1 |
| 5,169,031 | 12/1992 | Miller | 222/146.5 |
| 5,272,881 | 12/1993 | Lee | 62/50.4 |

FOREIGN PATENT DOCUMENTS

| | | | |
|---|---|---|---|
| 4036421 | 5/1992 | Germany | 141/64 |
| 146797 | 9/1983 | Japan | 62/50.1 |
| 37399 | 2/1984 | Japan | 62/50.1 |
| 106799 | 6/1984 | Japan | 62/50.1 |
| 139313 | 5/1990 | Japan | 141/64 |

*Primary Examiner*—Christopher Kilner
*Attorney, Agent, or Firm*—William H. Eilberg

[57] ABSTRACT

The present invention produces discrete droplets of cryogenic liquid, suitable for injection into receptacles such as cans or plastic bottles, at high speeds. A container of cryogenic liquid includes a hole and an orifice, spaced apart from each other, and defining a path for liquid to flow out of the container. A conduit directs a gas into the space between the hole and the orifice. The orifice is formed in an orifice plug which can be adjusted so as to vary the volume of the space between the hole and the orifice. When gas fills the space, the gas tends to prevent the outflow of liquid. When gas is withdrawn from the space, liquid can flow out of the container. By rapidly closing opening a valve which supplies gas to the space, and by proper choice the volume of the space, the liquid can be made to fall out of the container in discrete droplets.

20 Claims, 1 Drawing Sheet

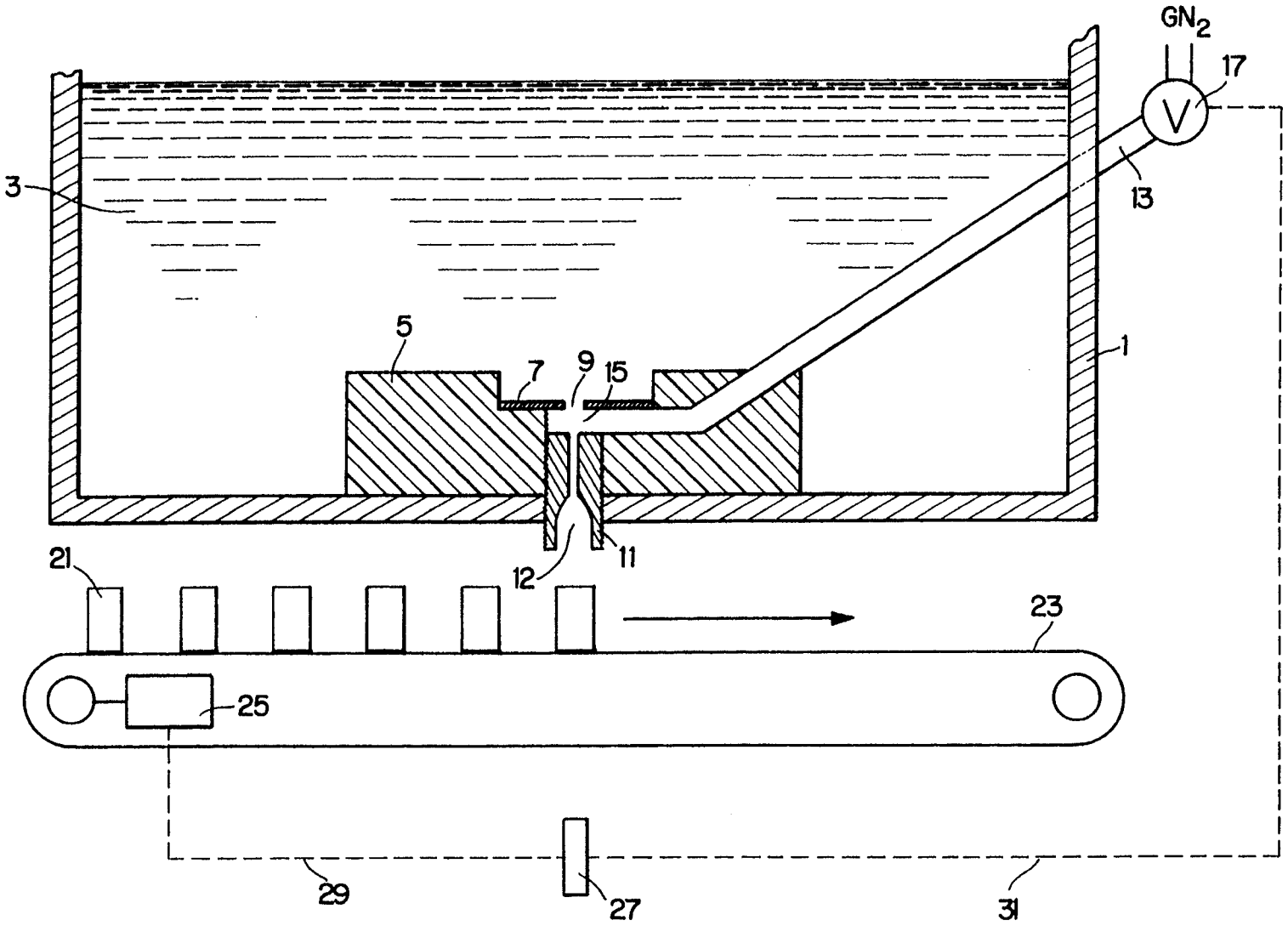
GN2
17
13
1
3
5
7
9
15
11
12
23
21
25
29
27
31

APPARATUS AND METHOD FOR DISPENSING DROPLETS OF A CRYOGENIC LIQUID

BACKGROUND OF THE INVENTION

This invention relates to the field of dispensing of cryogenic liquids, and includes a method and apparatus for dispensing precisely metered droplets of a cryogenic liquid. The invention is especially useful for adding liquid nitrogen to cans or plastic bottles, but it can be used in any other application requiring the controlled dispensing of droplets of a cryogenic liquid.

It has been known to make beverage cans of aluminum, which has the advantage of being light in weight and relatively low in cost. However, aluminum is comparatively soft. It is usually impractical to stack aluminum cans containing a liquid. Unless the liquid in the can is pressurized, as in the case of carbonated beverages, the cans at the bottom of the stack cannot withstand the pressure of the stack and are likely to be crushed. To overcome this problem, it has been known to inject a small amount of a cryogenic liquid, usually liquid nitrogen, into the can, immediately before the can is sealed. The cryogenic liquid vaporizes almost instantly, and expands to many times its original volume. The vaporized cryogen provides the desired internal pressure for the can.

U.S. Pat. Nos. 4,561,258 and 4,592,205 both show systems intended to provide delivery systems for cryogenic liquids, such as liquid nitrogen, for the purpose described above. However, the above patents provide steady streams of nitrogen. They do not generate discrete droplets, so it is not possible to place one droplet of cryogenic liquid into one can, without wasting additional cryogenic liquid.

Another system intended for dispensing liquid nitrogen into beverage cans appears in U.S. Pat. No. 4,588,000. In the latter patent, a rotating rating disk starts and stops the flow of liquid nitrogen into the cans. Vaporized cryogenic liquid helps to halt the flow of the liquid nitrogen after the liquid has been dispensed into a particular can. The latter patent injects small doses of cryogenic liquid into each can, but does not actually produce droplets. Moreover, the latter patent has the disadvantage that the metering/dispensing head requires a moving mechanical part, namely a rotating disk, which opens and closes a flow path for the cryogenic liquid.

Automated equipment exists which makes it possible to move cans or other receptacles through a plant at very high speeds. It is therefore desired to inject discrete droplets of cryogenic liquid into such receptacles, at high speeds, and without wasting significant amounts of liquid.

The present invention produces such droplets in a precise and controlled manner, and makes it possible to inject droplets of cryogenic liquid into receptacles at the rate of about 200–500 receptacles per minute. The apparatus of the present invention can be adjusted to optimize the production of droplets, and provides a reliable means of precisely controlling the flow of droplets of cryogenic liquid.

SUMMARY OF THE INVENTION

The apparatus of the present invention includes a container which holds a bath of a cryogenic liquid. The container has an opening in its bottom, the opening being surrounded by a block. The block itself defines an opening into which an orifice plug is adjustably inserted. The orifice plug defines an orifice which allows fluid to flow out of the container.

The block also defines a ledge which supports a flat plate having a central hole. The orifice plug and the plate are spaced apart from each other, so as to define a space between the plate and the orifice plug. The hole in the plate and the orifice in the orifice plug together define a path for liquid to flow out of the container. A conduit fluidly connects an external source of gas to the space between the plate and the orifice plug.

When gas flows through the conduit and into the space between the plate and the orifice plug, the gas becomes a barrier to the flow of liquid out of the container. When the pressure of the gas is reduced, the gas no longer acts as a barrier, and liquid can flow through the orifice, and out of the container. By repeatedly and rapidly stopping and starting the flow of the gas, one can precisely control the flow of the liquid, and the liquid falls out of the container in the form of discrete droplets. The production of droplets depends on the choice of dimensions of the space between the plate and the orifice plug, and on the pressure of the gas.

The invention therefore has the primary object of providing an apparatus and method for producing droplets of a cryogenic liquid.

The invention has the further object of providing an apparatus and method for increasing the speed at which one can generate discrete droplets of a cryogenic liquid.

The invention has the further object of improving the efficiency of an apparatus which injects cryogenic liquid into cans, bottles, or like.

The invention has the further object of injecting discrete droplets of cryogenic liquid into cans, at rates ranging from only a few droplets per minute to over 200 droplets per minute, wherein one droplet is injected into each container.

The invention has the further object of reducing the amount of cryogenic liquid that is wasted in systems for injecting such liquid into a plurality of receptacles.

The person skilled in the art will recognize other objects and advantages of the invention, from a reading of the following brief description of the drawing, the detailed description of the invention, and the appended claims.

BRIEF DESCRIPTION OF THE DRAWING

The FIGURE provides a partially cross-sectional view of the apparatus of the present invention, with some of the components being shown schematically.

DETAILED DESCRIPTION OF THE INVENTION

As shown in the FIGURE, container 1 holds a bath of cryogenic liquid 3. The preferred cryogenic liquid is liquid nitrogen, but other cryogenic liquids could be used instead.

Container 1 has an opening in its bottom, and a generally cylindrical block 5 surrounds the opening. The block comprises means for supporting a flat perforated plate 7, the plate having a central hole 9. The plate thus has the shape of an annulus, and the hole 9 allows liquid to flow through it. Orifice plug 11 is inserted into the opening in the bottom of the container. The orifice plug defines an orifice 12 which provides fluid communication between the interior and exterior of the container. The position of the orifice plug 11 is vertically adjustable. Preferably the orifice plug and the block are threaded, as shown in the FIGURE, so that the generally cylindrical orifice plug may be screwed into the block to a desired position. Other means of adjustable engagement of the orifice plug and the block are possible, however, and are within the scope of the invention.

The central hole 9 of plate 7, and the orifice 12, defined by the orifice plug 11, are generally concentric. The orifice and central hole are also symmetrical with respect to the block, though they could also be offset with respect to the block, without substantial change in results.

Conduit 13 conveys a gas, from a gas source (not shown), into the space 15 between the upper end of the orifice plug and the plate 7. The gas can be the vaporized form of the cryogenic liquid stored in the container, or it could be a different material. In the preferred embodiment, the cryogenic liquid and the gas are both nitrogen. But in the most general case, the source of gas can be entirely independent of the source of cryogenic liquid.

Solenoid valve 17, preferably located outside of the container, controls the flow of gas into space 15. In general, when sufficient gas is forced into space 15, the gas blocks the outflow of liquid from the container. When the gas flow is cut off, the gas pressure in space 15 falls, and liquid can flow out of the container. Closing and opening valve 17 therefore causes the flow of liquid to start and stop. If the position of the orifice plug is correctly set, repeated closing and opening of the solenoid valve will cause discrete droplets of cryogenic liquid to fall from the container.

The FIGURE also shows, in schematic form, the other components that compete a system for injecting droplets into receptacles. Receptacles 21 are transported by conveyor 23 which is driven by motor 25. Position sensor 27 determines when a receptacle is directly aligned with orifice 12. The position sensor can be a photoelectric device or other sensor capable of detecting the presence or absence of a can or bottle at a particular location on the production line. The position sensor is connected to control the motor 25 and the valve 17. Dotted lines 29 and 31 symbolize the remote control of the conveyor and/or the valve by the output of the position sensor.

Normally, the valve is open, so that gas fills space 15 and blocks the flow of liquid. When the sensor determines that the can or bottle is directly under the orifice, the valve 17 is closed for an interval of time (typically of the order of several milliseconds), and this rapid reduction in gas pressure allows a droplet of cryogenic liquid to fall from the container. The size of the droplet depends on the diameter of the outlet orifice and the time interval during which the valve is closed. The controlled and intermittent flow of gas thus produces a steady output of droplets of cryogenic liquid.

A timer (not shown in the FIGURE) controls the operation of the valve. After the sensor sends a signal to close the valve 17, the timer takes control, and holds the valve closed for a predetermined interval. Thus, in the preferred embodiment, the sensor relinquishes control over the valve after the sensor issues a signal, and the valve is momentarily controlled by the timer, until it has opened again to await the next signal from the sensor. Note, therefore, that in the preferred embodiment, the valve is not directly controlled by the signal from the sensor at all times.

In the present invention, orifice 12, defined by orifice plug 11, is permanently open. The gas pressure in conduit 13 controls the flow of liquid out of the container. Except for the solenoid valve itself, the dispensing apparatus has no moving mechanical parts. The absence of moving parts in the immediate vicinity of the orifice is especially important, as it substantially improves the reliability of the apparatus.

The volume of space 15 is important. If this volume is too large, it becomes impossible to produce droplets, as it is no longer possible to cut off the flow of cryogenic liquid almost instantly. Moreover, the large volume of gas must be dissipated before the liquid can begin to flow. On the other hand, if the volume of the space is too small, the gas flow may be insufficient to stop the flow of liquid, and again one will not be able to produce discrete droplets.

There can be no single preferred value for the volume of space 15 because the optimum volume depends on the pressure of the gas injected into conduit 13, and on the rate at which one desires to generate droplets. For a particular gas pressure and desired rate, there is an optimal value (or a small range of optimal values) for the volume of space 15, and one must determine that volume experimentally, i.e. by adjusting the position of orifice plug 11 until the apparatus produces droplets as desired. Once the correct setting of the orifice plug has been found, it can be left in its position, provided that the pressure of the gas does not change significantly.

In one example, the cryogenic liquid is nitrogen, and the gas is also nitrogen, supplied at a pressure of about 2–3 psig. One desires to produce about 200–500 droplets per minute. The optimum distance between the upper end of the orifice plug 11 and the plate 7 is about 0.0625–0.0938 inches. The diameter of central hole 9 is about 0.125 inches. The diameter of the opening defined by block 5 (which is the outside diameter of the orifice plug 11) is about 0.375 inches. The orifice begins with a diameter of about 0.0625 inches and flares to a maximum of about 0.25 inches. Note that, in the FIGURE, the components in the vicinity of the orifice are shown approximately to scale, to illustrate this example. However, the receptacles have not been drawn to scale.

The numbers given above are intended only as an example, and should not be construed to limit the invention. Many other choices of dimensions are possible, all within the scope of the invention.

The pressure of the gaseous nitrogen could be as high as 3 psig, or higher. However, higher pressures are normally undesirable because they waste gas unnecessarily. The plate 7 is important because without it, one would not be able to stop the flow of the cryogenic liquid at all. The diameter of central hole 9 can be varied, but it must not be too small; otherwise, one could not achieve the desired rapid control of the production of droplets, because the hole would unduly impede the flow of liquid out of the container.

The present invention is capable of producing droplets of cryogenic liquid at a very precisely controlled rate. One can produce droplets very slowly, even as slowly as one droplet per minute, or very rapidly, of the order of 200–500 droplets per minute, and at any rate between these extremes. Above the rate of 500 droplets per minute, the output can no longer be considered droplets, but instead comprises a stream of cryogenic liquid.

In practice, the container comprises the inner vessel of a three-vessel arrangement. A middle vessel surrounds the inner vessel, and an outer vessel surrounds the middle vessel. The outer vessel provides insulation for the entire assembly. The FIGURE shows only the inner vessel.

The purpose of the middle vessel is as follows. Some of the liquid nitrogen in the container vaporizes and escapes through vent holes in the container (not shown). The gas passing through the vent holes enters the middle vessel, and is directed downward. This gas exits the container through a separate orifice (not shown), which orifice is located in the immediate vicinity of the second orifice 12. The gas displaces ambient air in the area of the second orifice, and thus tends to prevent ambient air from contacting the liquid droplets which fall from orifice 12. This arrangement prevents the buildup of ice in the vicinity of the orifice 12, which would otherwise occur when the cryogenic liquid droplets cause moisture in the air to freeze. In other words, the gas flowing in the middle vessel prevents ambient air from contacting the stream of droplets of cryogenic liquid. Note that the middle vessel is, in general, entirely independent from the conduit 13, and the gas in the middle vessel is independent of the gas in the conduit 13.

While the invention has been described with respect to particular embodiments, one can modify the invention in various ways. The means for making the orifice plug adjustable can vary. The precise shape of the orifice plug, and that of the container and internal block, can also be varied. The manner of controlling the valve can be changed; one could devise a system which directly controls the valve based on the output of the position sensor, without using a timer. These and other modifications which will be apparent to the reader skilled in the art should be considered within the spirit and scope of the following claims.

What is claimed is:

1. Apparatus for dispensing droplets of a cryogenic liquid, the apparatus comprising:

a) container means for storing a cryogenic liquid, b) the container means having a bottom, the bottom defining an opening, the opening being surrounded by a block, c) the block comprising means for holding a plate and an orifice plug, the plate having a hole, the orifice plug being adjustably inserted to a predetermined distance into the block, the orifice plug defining an orifice which permits the cryogenic liquid to flow through the hole and through the orifice and out of the container means, wherein there is a space between the plate and the orifice plug, and d) means for intermittently directing a gas into the space, wherein the directing means comprises means for permitting the cryogenic liquid to fall out of the container means in the form of droplets.

2. The apparatus of claim 1, wherein the orifice plug is threadedly inserted into the block.

3. The apparatus of claim 1, wherein the gas comprises a vaporized form of the cryogenic liquid.

4. The apparatus of claim 1, further comprising valve means for controlling gas flow into the space, wherein said valve means has a first position which allows gas to flow into the space and to prevent the flow of cryogenic liquid out of the container means, and wherein said valve means has a second position which prevents gas from flowing into the space and permits cryogenic liquid to flow out of the storing means.

5. Apparatus for dispensing droplets of a cryogenic liquid from a container, the apparatus comprising means defining a hole and an orifice, the hole and orifice being positioned to allow the cryogenic liquid the flow through the hole and then through the orifice and then out of the container, wherein the hole and the orifice are spaced apart from each other, wherein there is a space between the hole and the orifice, the apparatus further comprising means for directing gas into said space, and means for controlling flow of said gas, wherein flow of liquid out of the container is controlled by controlling the flow of gas into said space.

6. The apparatus of claim 5, wherein the hole is formed in a generally flat plate.

7. The apparatus of claim 6, wherein the orifice is defined by an orifice plug, the apparatus comprising means for adjusting a position of the orifice plug relative to the plate.

8. The apparatus of claim 7, wherein the plate and the orifice plug are held by a block formed in the container.

9. The apparatus of claim 5, wherein the gas is the vaporized form of the cryogenic liquid in the container.

10. The apparatus of claim 5, further comprising means for conveying a plurality of receptacles into a vicinity of the orifice, and means for sensing the position of one of said receptacles, the sensing means being operatively connected to means for actuating the conveying means and to the directing means, wherein droplets of the cryogenic liquid can be injected into the receptacles passing by the orifice.

11. An apparatus for dispensing droplets of a cryogenic liquid into a plurality of receptacles at high speed, the apparatus comprising:

a) container means for storing a cryogenic liquid, b) means defining a hole and an orifice, the hole and orifice being spaced apart, the hole and the orifice providing a path for the cryogenic liquid to flow out of the container means, wherein there is a generally restricted space between the hole and the orifice, c) means for controllably directing gas into said space, so as to control flow of liquid out of the container means, d) means for conveying receptacles towards the container means, e) means for sensing a position of each of said receptacles, wherein the sensing means is operatively connected to the gas directing means, wherein flow of the gas is controlled such that droplets of liquid fall from the container means into the receptacles.

12. The apparatus of claim 11, wherein the sensing means is also operatively connected to the conveying means.

13. The apparatus of claim 11, wherein the orifice defining means comprises means for adjusting the volume of said space.

14. The apparatus of claim 13, wherein the hole is formed in a generally flat plate.

15. The apparatus of claim 14, wherein the orifice is defined by an orifice plug which is adjustably inserted into a block formed in the container means.

16. An apparatus for dispensing droplets of a cryogenic liquid, comprising:

a) a container for storing a cryogenic liquid, b) means defining a hole and an orifice, the hole and orifice being spaced apart, the hole and the orifice providing a path for the cryogenic liquid to flow out of the container means, wherein there is a generally restricted space between the hole and the orifice, and c) means for intermittently directing gas into said space, so as to control flow of liquid out of the container means.

17. A method for producing droplets of a cryogenic liquid, the method comprising the steps of:

a) providing a container of cryogenic liquid, and a hole and an orifice which together define a path for the cryogenic liquid out of the container, the hole and the orifice being spaced-apart by a predetermined distance, wherein there is a space between the hole and the orifice, the space having a predetermined volume, b) adjusting the distance between the hole and the orifice and thereby varying the volume of said space, and c) controllably directing gas into said space, wherein the presence of gas in the space tends to prevent liquid from flowing out of the container, and wherein the absence of gas in the space tends to allow liquid to flow out of the container.

18. The method of claim 17, wherein the directing step comprises the step of opening and closing a valve so as to allow gas to flow into the space, wherein the opening and closing is performed with sufficient speed to allow only discrete droplets of liquid to fall out of the container.

19. The method of claim 18, wherein the valve is opened and closed in response from a signal from a position sensor, the position sensor comprising means of determining the presence of a receptacle in a vicinity of the container.

20. The method of claim 19, wherein the valve is normally open, and wherein the valve is closed for a predetermined interval of time in response to the signal from the position sensor.

* * * * *